United States Patent [19]

Downing

[11] Patent Number: 4,645,152

[45] Date of Patent: Feb. 24, 1987

[54] UPRIGHT GOLF BAG SUPPORT

[76] Inventor: Donald M. Downing, 4408 S. 41 W Ave., Tulsa, Okla. 74107

[21] Appl. No.: 769,351

[22] Filed: Aug. 26, 1985

[51] Int. Cl.[4] ..... A63B 55/00

[52] U.S. Cl. ..... 248/96; 206/315.7; 248/156

[58] Field of Search ..... 248/96, 97, 95, 99, 248/100, 101, 156; 206/315.7

[56] References Cited

U.S. PATENT DOCUMENTS

| | | | |
|---|---|---|---|
| 2,633,317 | 3/1953 | Marsh | 248/96 |
| 2,751,176 | 6/1956 | Mowry | 248/96 |
| 2,966,290 | 12/1960 | DeAngelis | 248/97 X |
| 3,570,795 | 3/1971 | Benzel | 248/156 X |
| 3,747,882 | 7/1973 | Leis | 206/315.7 X |

*Primary Examiner*—Ramon O. Ramirez

*Attorney, Agent, or Firm*—Head, Johnson & Stevenson

[57] ABSTRACT

A golf bag is retained vertically upright during the time of club selection and play by a lightweight vertical housing which includes a spike and a pivotal foot plate normally biased and detained in a retracted position. The foot plate is movable to a transverse position for pushing the spike into the ground. Pulling the bag upward retracts the spike and foot plate to a detented and retracted position.

10 Claims, 9 Drawing Figures

UPRIGHT GOLF BAG SUPPORT

SUMMARY OF THE INVENTION

It is an object of this invention to provide an apparatus for holding a golf bag in an upright 'free standing' position for club selection and use by a player or caddy.

More particularly the invention has for its object to provide a lightweight golf bag support, adjustably and readily attachable in a vertical position to the golf bag. The support includes a spike which is vertically movable, against the tension of a spring bias, into a downward position beyond the bottom of the golf bag into the ground and is automatically retractable upon the raising of the bag from the ground.

Specifically, the invention is directed to an apparatus for holding a golf bag in a free standing upright position on the ground. A support housing means is vertically attached to the bottom and top cuff of a typical golf bag. The bottom of the support housing means being adjacent the bottom of the bag. A ground spike is vertically and movably retained at the bottom of the support housing. A foot plate is secured to the spike contiguous to the top thereof with the plate pivotal to and from a first position that is transverse to the spike for pushing the spike into the ground with one's foot and a second retracted position. A detent means formed as a part of the foot plate cooperates with a catch to releasably hold the plate in the second retracted position. A means is attached to the spike to normally bias same in the second retracted position.

DETAILED DESCRIPTION OF THE PREFERRED EMBODIMENT

Before explaining the present invention in detail, it is to be understood that the invention is not limited to its application to the details of construction and arrangement of parts illustrated in the accompanying drawings, since the invention is capable nof other embodiments and of being practiced or carried out inn various ways commensorate with the claims herein. Also it is to be understood that the phraseology or terminology employed herein is for the purpose of description and not of limitation.

Figure 1:
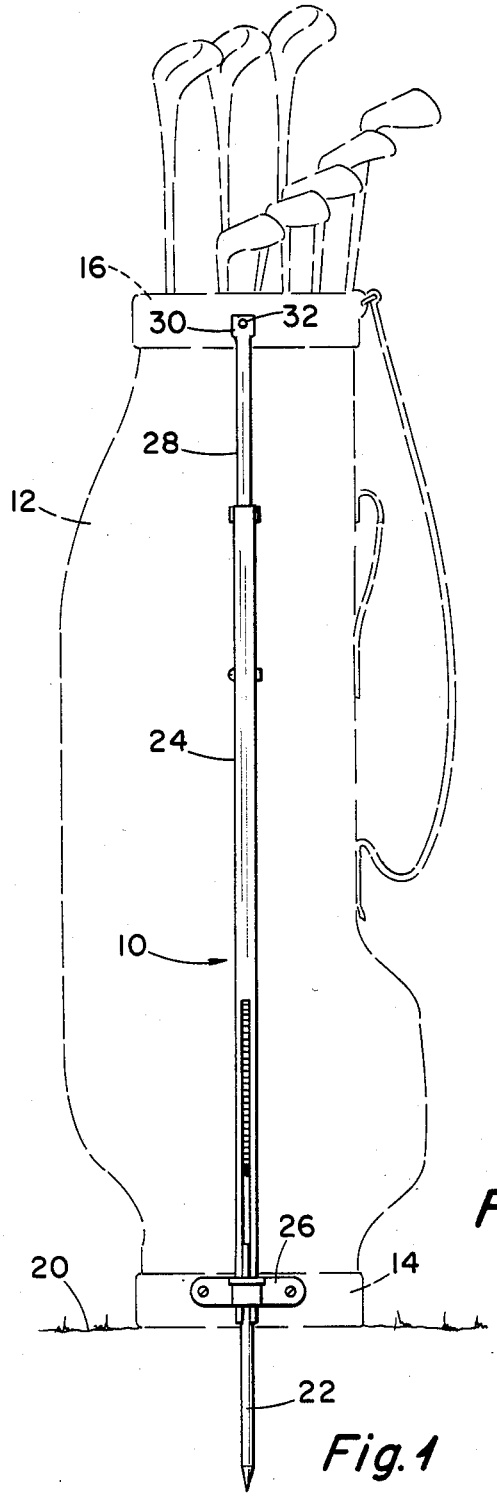
FIG. 1 is a side elevational view showing the apparatus of this invention in use.

Referring now to FIG. 1 the apparatus of the invention is generally designated by the numeral 10, which is shown attached to a golf bag 12 shown in phantom, in this particular instance, by brackets to the usually rigid bottom cuff 14 and top cuff 16. The bag is shown in its vertical position at rest on ground 20. The bag being held in the upright standing position by the apparatus 10 and particularly by the placement of spike 22 into the ground as shown.

Figure 3:
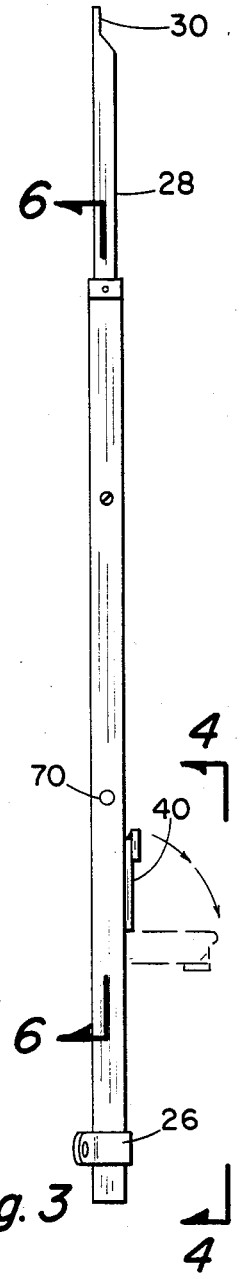
FIG. 3 is a side elevational view of the apparatus of this invention in its second retracted position.
Figure 2:
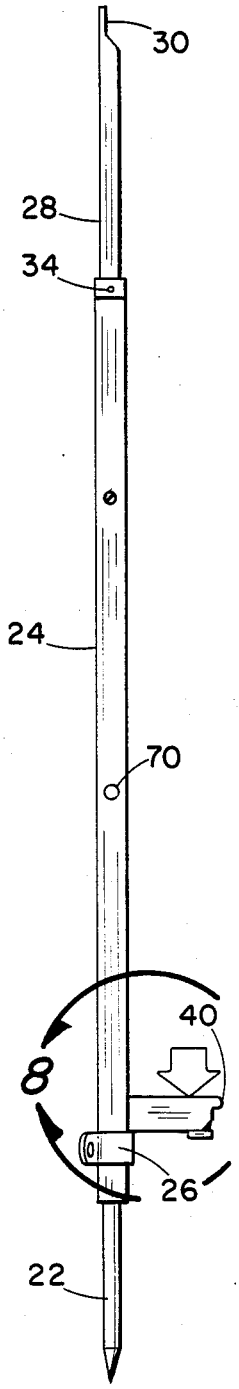
FIG. 2 is a side elevational view of the apparatus of this invention in a first position.
Figure 6:
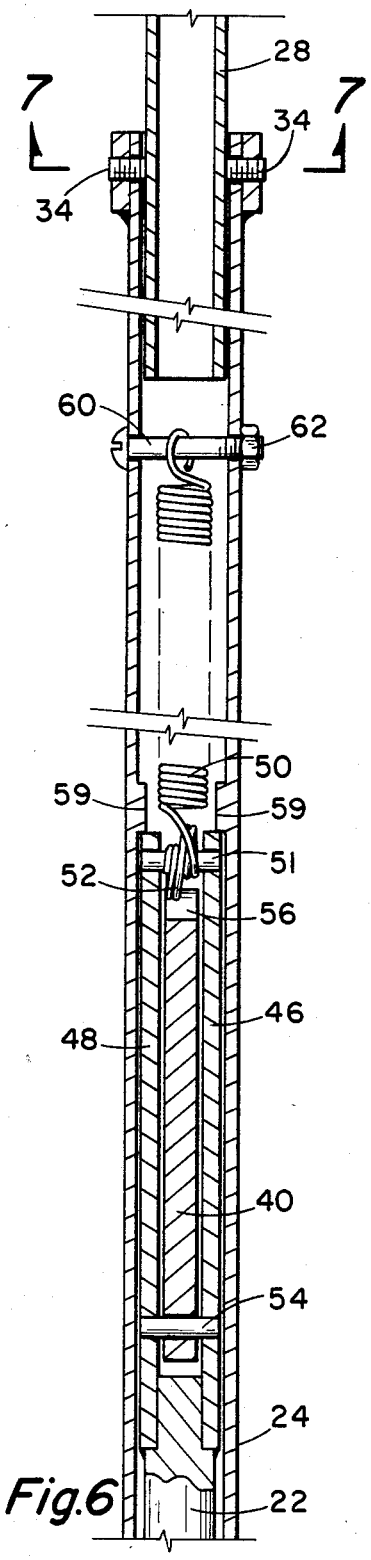
FIG. 6 is a partial sectional view taken along the line 6—6 of FIG. 3.
Figure 7:
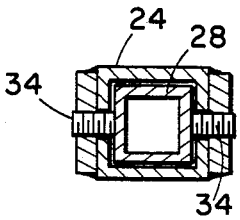
FIG. 7 is a sectional view taken along the line 7—7 of FIG. 6.
Figure 8:
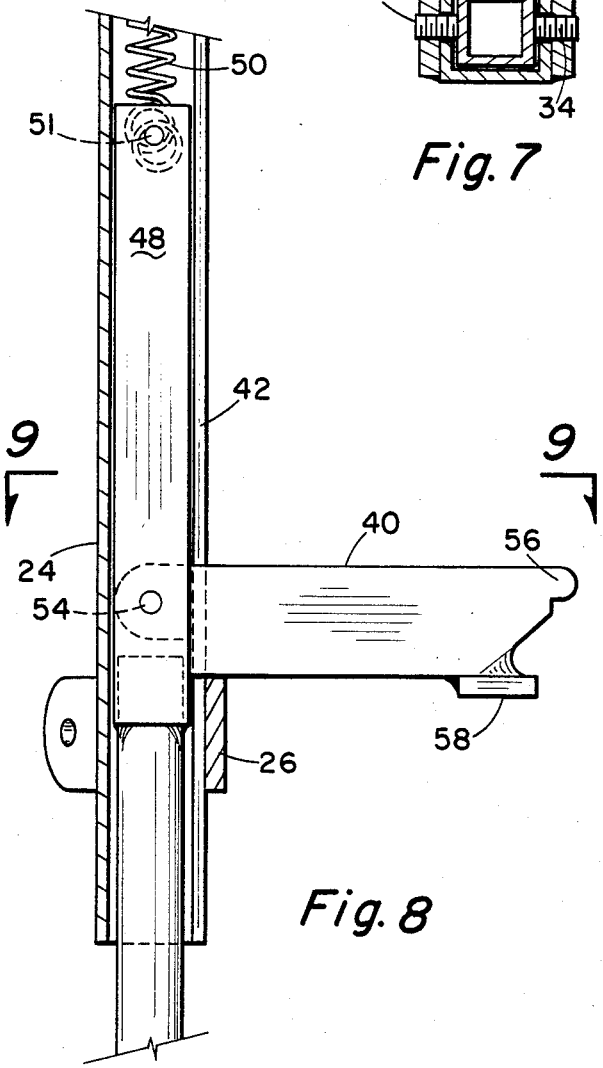
FIG. 8 is a partial sectional view of detail 8 in FIG. 2.

The details of the apparatus of the invention is best described in the remaining views. Referring now to FIG. 2, the apparatus comprises a tubular housing 24 which has a lower bracket 26 for attachment to the bottom cuff 14 of golf bag 12. An upper extension 28 of the housing includes a flattened portion 30 having an opening 32 for the attachment of a nut and bolt to the upper cuff 16 of bag 12. The upper extension is telescopically movable within the housing 24 for adjustment to various length golf bags. The upper extension is then locked together with the housing 24 by means of lock nuts 34. The details of the lock nuts are best shown in FIGS. 6 and 7. A foot plate 40 is pivotly attached to the top of spike 22 for movement in a first position as shown in FIG. 2 for pushing the spike in the ground and to a second retracted position as shown in FIG. 3.

Figure 5:
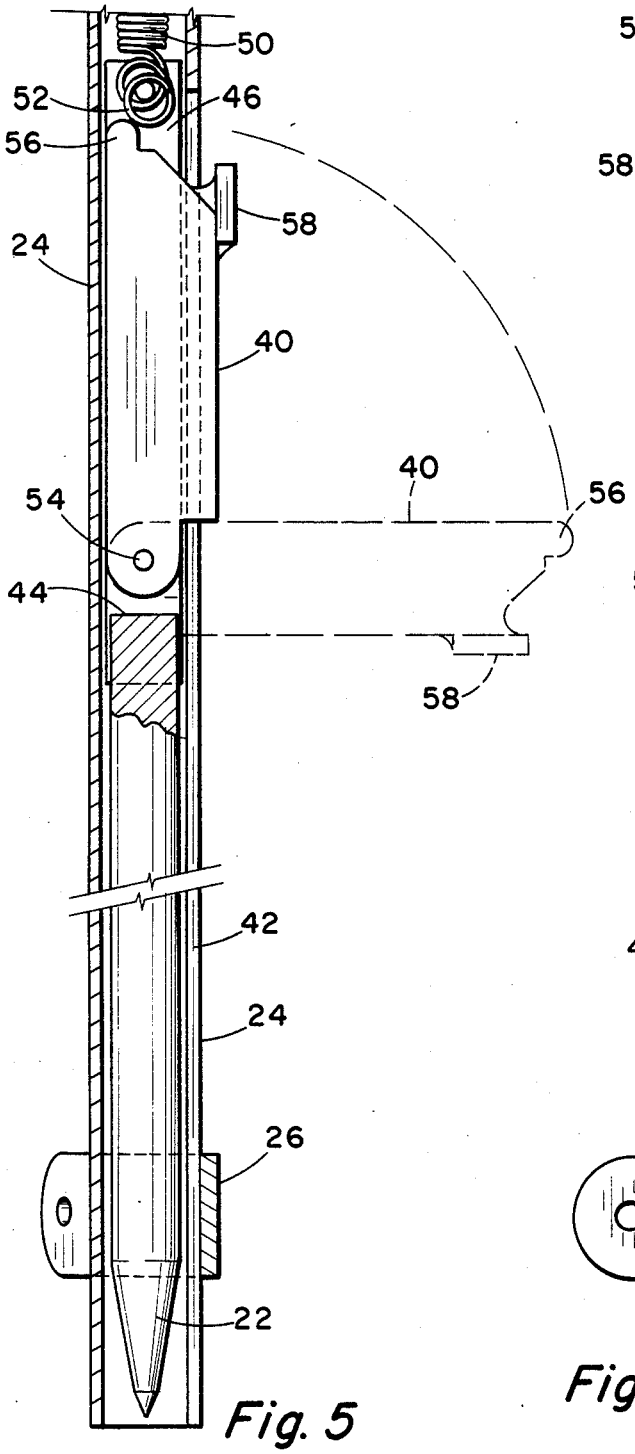
FIG. 5 is a sectional view taken along line 5—5 of FIG. 4.
Figure 4:
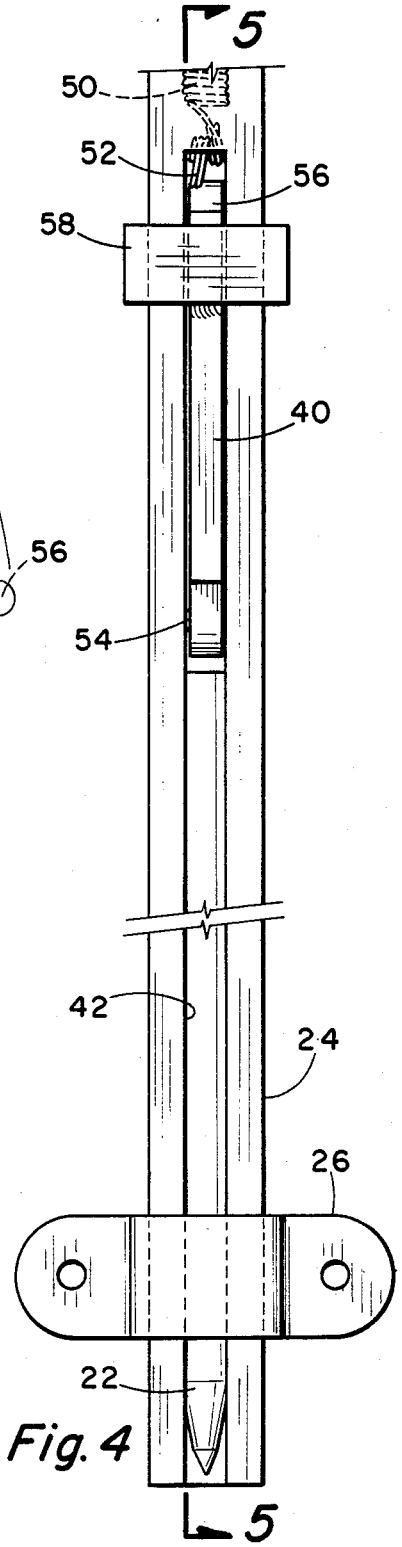
FIG. 4 is a partial front view of the lower assembled apparatus of this invention.
Figure 9:
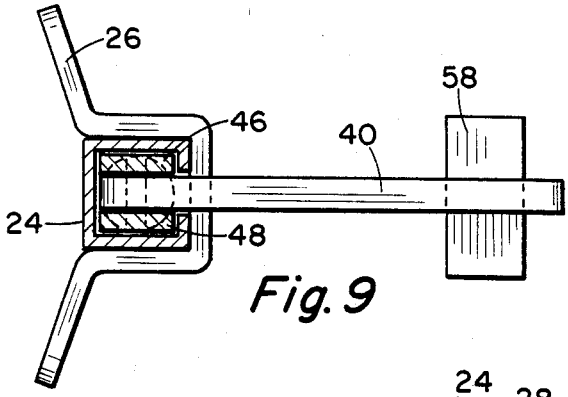
FIG. 9 is a sectional view taken along the line 9—9 of FIG. 8.

Further detail description of the invention is made by reference to FIGS. 4 and 5, showing the lower portion of the apparatus. The housing 24 includes a vertical slot 42, adjacent the bottom, within which spike 22 is retained as assembled. At the upper end 44 of the spike, a pair off parallel arms 46 and 48 (see FIGS. 6 and 9) form a yoke having its opening to coincide with vertical slot 42. A tension spring 50 has its bottom end attached to the yoke arms 46 and 48 at the top thereof in such a manner as to leave an extended portion 52 of the spring which becomes a detent catch for the foot plate 40 as hereinafter described. The spring 50 being in tension thus normally biases the assembled spike, yoke, and foot plate into its upward retracted position as shown in FIGS. 4 and 5. The foot plate is pivotally attached at 54 to the yoke plates 46 and 48. The foot plate further includes a detent 56 which operatively engages with the catch spring 52 for retaining the foot plate in its retracted position. The foot plate 40 further includes a kick plate 58 which is usually engaged by the toe of the user to pivot foot plate 40 into the first position shown by the dotten lines of FIG. 5.

Referring to FIGS. 6–9, will provide further description of the assembled apparatus of this invention. The upper end of spring 50 is attached to housing 24 by means of a bolt 60 and nut 62. As previously indicated the adjustable portion 28 is retained to the housing 24 by means of a threaded allen screws 34 or other typical means.

The support is assembled by inserting extension 28 into housing 24 using set screws 34. The spike 22 and attached yoke arms 46 and 48 have the bottom end of spring 50 attached using pin 51. This assembly is inserted into the housing 24 where the other end of the housing 24 where the other end of the spring is attached with bolt and nut 60, 62. Foot plate 40 is attached to the yoke by inserting the detent end into the opening 42 and with the assembly positioned coaxial to opening 70 an expansion type pivot pin 54 is inserted. Alternately the foot plate 40 can be attached before the top of the spring 50.

In use, the apparatus of the invention is attached to a golf bag 12 by first determining the desirable, vertical length of the apparatus 10 by telescopically moving the vertical extension 28 and locking same to the given length by inserting set screws 34. Thereafter bracket 26 is attached to bottom cuff 14 and the upper extension 28 is attached to the upper cuff 16.

In use, the player will rest the bag on the ground and with his toe engage plate 58 to move the foot plate 40 from its detent catch 52 into a horizontal or transverse position. The player then steps on the top of the foot plate 40 and pushes downward to cause spike 22 to go into the ground as shown in FIGS. 1 and 2. The friction of the spike into most ground conditions will stay in the downward position. The foot plate is restrained from further downward vertical movement by engagement with the bracket 26. Once the player has selected his club, played and returned the club to the bag, the bag is lifted vertically. Because of the tension of coil spring 50 the assembly is caused to retract rapidly to an upward position where the yoke strikes inward stops 59. Because of the momentum and the abrupt stop of the assembly the foot plate 40 will then continue to pivot to its second retracted position wherein detent 56 will engage with catch 52 and retain the foot plate in its retracted position.

What is claimed is:

1. Apparatus for holding a golf bag upright to the ground comprising:

support means vertically attached to said bag, the bottom of which is adjacent the bottom of said golf bag;

a ground spike vertically and movably retained in a first position having its bottom section slightly above the bottom of said support means;

a foot plate means secured to said spike in a first position parallel to said spike, the plate pivotal from said first position to a second position transverse to said spike for pushing the spike beyond the bottom section of said support means into the ground and a second position, detent means on said plate and a catch for said detent means in said support means to releasably hold said plate in said first position; and means to normally bias said spike upwardly in said second position which automatically retracts the spike and plate means to their first positions when the spike is pulled from the ground.

2. Apparatus of claim 1 wherein said support means comprises a tubular housing with said ground spike, said foot plate means, and means to bias said spike being assembled and retained substantially within said housing.

3. Apparatus of claim 1 wherein said support means is vertically adjustable for different length golf bags.

4. Apparatus of claim 1 wherein said support means includes a means to stop said upwardly bias of said spike.

5. Apparatus of claim 4 wherein said means to stop comprises indented spot welds.

6. Apparatus of claim 1 wherein said means to normally bias is a tension coil spring.

7. Apparatus of claim 6 wherein a portion of the end of said spring becomes said catch to cooperate with said detent means to releasably hold said plate in said first position.

8. Apparatus of claim 1 including means to stop the downward pushing movement of said spike.

9. Apparatus of claim 1 wherein said foot plate includes a transverse kick plate.

10. Apparatus for holding a golf bag upright on the ground comprising:

a tubular housing including means to adjust the vertical length of said housing, said housing vertically attached to said bag, such that the bottom of said housing is adjacent the bottom of said bag, a vertical slot along the bottom of said housing;

means substantially assembled within said housing comprising, a ground spike telescopically retained in a first position at the bottom of said housing, a yoke attached to the top of said spike, the opening of said yoke being open to said vertical slot, a tension spring attached at its upper end to said housing, and at its bottom end to said yoke, a portion of the bottom end of said spring extending downward into said yoke to form a catch, said tension spring normally biasing said yoke and spike upwardly;

a foot plate, said plate pivotally secured at the bottom of said yoke, said plate pivoted to and from a first position parallel to the spike to a second position transverse to said spike for pushing said spike into the ground and a second position nested in said vertical slot and said yoke opening, said plate including a detent which in said first position releasably engages with said catch; and means attached to said housing to stop the upward movement of said yoke when the spike is pulled from the ground and automatically retracts to its first position.

* * * * *